US007845463B2

(12) United States Patent
Yabe et al.

(10) Patent No.: US 7,845,463 B2
(45) Date of Patent: Dec. 7, 2010

(54) LOW-NOISE MACHINE PACKAGE

(75) Inventors: Toshiaki Yabe, Shizuoka (JP); Kazuaki Shiinoki, Yokohama (JP); Kazuyoshi Iida, Iruma (JP); Koji Ikeda, Sakai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 12/023,083

(22) Filed: Jan. 31, 2008

(65) Prior Publication Data

US 2008/0179135 A1 Jul. 31, 2008

(30) Foreign Application Priority Data

Jan. 31, 2007 (JP) ..... 2007-021594

(51) Int. Cl.
*G10K 11/04* (2006.01)

(52) U.S. Cl. ..... 181/200; 181/198; 181/202; 415/211.1; 415/211.2

(58) Field of Classification Search ..... 181/198, 181/200, 202; 412/211.1, 211.2
See application file for complete search history.

(56) References Cited

U.S. PATENT DOCUMENTS

| | | | | |
|---|---|---|---|---|
| 1,865,677 | A * | 7/1932 | Cheyney | 454/370 |
| 2,089,928 | A * | 8/1937 | Perkins | 165/126 |
| 3,313,342 | A * | 4/1967 | Laing | 165/124 |
| 3,421,687 | A * | 1/1969 | Daily | 415/121.2 |
| 4,460,086 | A * | 7/1984 | Davis | 206/389 |
| 5,663,536 | A * | 9/1997 | Kaplan | 181/224 |

(Continued)

FOREIGN PATENT DOCUMENTS

CN 2253692 Y 5/1997

(Continued)

OTHER PUBLICATIONS

PAJ machine translation of (JP2000-087725).*

(Continued)

*Primary Examiner*—Jeffrey Donels
*Assistant Examiner*—Forrest M Phillips
(74) *Attorney, Agent, or Firm*—Antonelli, Terry, Stout & Kraus, LLP.

(57) ABSTRACT

A conventional machine package faces problems concerned with costs, weight, etc. and also a problem of antinomy that an attempt to enhance the noise reducing performance increases the airflow resistance and then deteriorates the cooling performance. Providing a sound absorbing structure with the heat radiation performance ensured within a practical range and then with considerably improved noise reducing effect achieves a low-noise machine package with a downsized casing and a reduced cooling fan power. There is provided a sound absorbing structure having a plurality of polyester fiber sound absorbing cylinders each formed into a circular-cylindrical shape, formed of a base material of polyester fiber whose surface is combined and covered with polymer non-woven fabric of polyester fiber or the like, and arranged at a support member in at least either of a suction port and an exhaust port in such a manner that long axes of the sound absorbing cylinders intersect substantially perpendicularly with a flow direction of air flowing through the suction port or the exhaust port. This makes it possible to reduce noise while controlling the airflow resistance minimum, thus achieving downsizing of a cooling fan and reduction of a cooling fan power.

9 Claims, 13 Drawing Sheets

U.S. PATENT DOCUMENTS

| | | | | |
|---|---|---|---|---|
| 6,273,213 | B1 * | 8/2001 | Callas et al. | 181/200 |
| 6,481,527 | B1 * | 11/2002 | French et al. | 181/201 |
| 6,606,876 | B1 * | 8/2003 | Giordano | 62/244 |
| 7,314,113 | B2 * | 1/2008 | Doll | 181/225 |
| 2004/0242109 | A9 * | 12/2004 | Tilton et al. | 442/415 |

FOREIGN PATENT DOCUMENTS

| | | |
|---|---|---|
| JP | 02-298619 | 12/1990 |
| JP | 9-26177 | 1/1997 |
| JP | 9-126666 | 5/1997 |
| JP | 2000-87725 | 3/2000 |
| JP | 2002-266756 | 9/2002 |
| JP | 2005-299464 | 10/2005 |
| KR | 20-0279605 | 6/2002 |

OTHER PUBLICATIONS

PAJ machine translationof (JP2002-266756).*
Korean office action dated Jan. 21, 2009.
Korean office action dated Sep. 15, 2009.
Chinese office action dated Oct. 16, 2009.

* cited by examiner

X-X SECTION

LOW-NOISE MACHINE PACKAGE

CLAIM OF PRIORITY

The present application claims priority from Japanese application serial No. 2007-21594 filed on Jan. 31, 2007, the content of which is hereby incorporated by reference into this application.

BACKGROUND OF THE INVENTION

The present invention relates to a machine package having a sound absorbing structure for reducing noise radiated from an opening provided for cooling down heat generated from a machine, such as an industrial machine, having a suction port and an exhaust port.

Most typically used as a conventional sound absorbing structure for an opening are: a lined duct using a porous material such as glass wool, a sprit type, a cell-type, etc., a basic form of each of which is a duct lined with a sound absorbing member.

The duct lined with a sound absorbing member faces a decrease in the amount of sound reduction in a high sound area where the wavelength of sound is smaller than the diameter or short side of a cross section thereof since a sound wave travels in a beam-like form. Often used to prevent this defect as much as possible are: a cell type as a parallel type of thin straight paths formed by dividing the duct cross section in a grid form by a sound absorbing member; and a splitter type sound absorbing duct dividing the flow path in parallel by a tabular sound absorbing member.

However, even with these types, the amount of sound reduction is controlled by sound absorbing properties of the sound absorbing member and the length of the duct subjected to sound absorbing processing. Thus, to provide effect for high sounds and further increase the sound absorption coefficient in a low sound area by providing the split type, the cell type, or the like, it is required to increase the thickness of the sound absorbing member, thus resulting in an increase in the fluid resistance. The conventional sound absorbing structure of a sound absorbing duct type requires space for noise in a band of 500 to 2 kHz which finds the widest applications, and thus faces problems concerned with costs, weight, etc. and also a problem of antinomy that an attempt to enhance the noise reduction performance increases the airflow resistance and then deteriorates the cooling performance.

Additionally, it is also possible to achieve noise reduction by installing a louver or forming the duct into a maze shape, although it suffers from the same problems as described above.

As their solution, Japanese Patent Application Laid-Open Publication No. H9-126666 describes a sound reducing assembly having substantially circular-cylindrical sound absorbing members formed of a sound absorbing material and also arranged in at least two rows across an air inlet.

Japanese Patent Application Laid-Open Publication No. 2000-87725 describes an acoustic damping material formed with a sound absorbing member and a acoustic reflection member provided on one side of this sound absorbing member and having a cross-sectionally concave-shaped reflection surface so that sound transmitted through and incident on the sound absorbing member is absorbed while being reflected by the reflection surface to elongate the sound absorbing distance in the sound absorbing member and then emitted to the side where sound S has arrived.

Japanese Patent Application Laid-Open Publication No. H9-26177 describes an air duct having a sound absorbing function that, by fitting a sound absorbing member using ion exchange fiber to a gas flow path, utilizes sound absorbing effect and gas pollutant removing operation to purify gas. Japanese Patent Application Laid-Open Publication No. 2002-266756 describes a sound absorber which has, inserted in a rectangular-cylindrical casing, a circular-cylindrical sound absorbing element having a pipe of an inorganic fiber whose front and rear surfaces are coated with an anti-scattering material of breathable inorganic fiber, organic fiber, glass cloth, nonwoven fabric, or the like.

The conventional duct lined with a sound absorbing member or, as its application, the cell-type and the splitter-type have many problems in practical aspects such as sound reducing performance, space, weight, costs, etc., since an attempt to increase the amount of sound reduction for a band of 500 to 2 kHz in highest need of sound reduction requires narrowing down the duct length, the thickness of the lined sound absorbing member, and the opening, which results in an increase in the airflow resistance.

The configuration described in Japanese Patent Application Laid-Open Publications No. H9-126666 and 2000-87725 has the cylindrical sound absorbing member arranged in such a manner as to intersect with airflow, and thus provides the effect of reducing the airflow resistance, but did not give sufficient consideration to sound absorbing properties concerning the material of the sound absorbing member with respect to the sound absorbing effect.

Further, the configuration described in Japanese Patent Application Laid-Open Publications No. H9-26177 and 2002-266756 has the sound absorbing member arranged in parallel to airflow and thus has the same problem as the aforementioned cell-type and splitter-type have, and further does not give sufficient consideration to sound absorbing properties concerning the material of the sound absorbing member with respect to the sound absorbing effect.

SUMMARY OF THE INVENTION

To address the problem described above, a low-noise package according to one aspect of the present invention includes a sound absorbing structure having a plurality of polyester fiber sound absorbing cylinders formed into a circular-cylindrical shape and arranged at a support member in at least either of a suction port and an exhaust port in such a manner that long axes of the sound absorbing cylinders intersect substantially perpendicularly with a flow direction of air flowing through the suction port or the exhaust port.

The polyester fiber sound absorbing cylinder may be a sound absorbing body formed of a base material of polyester fiber whose surface is circular-cylindrically wound and combined with polymer nonwoven fabric.

A structure may be provided which has a solid shaft or a hollow shaft penetrated through a circular-cylindrical center of the polyester fiber sound absorbing cylinder.

On the polymer nonwoven fabric, a metallic or resin-based network structure or perforated structure may be provided.

The support member may be a polyester fiber sound absorbing member.

The polyester fiber sound absorbing member may be provided as a sound absorbing structure formed of a base material of polyester fiber whose surface is combined with polymer nonwoven fabric.

The base material may be glass wool or flexible urethane foam.

The sound-absorbing structure may be in a freely detachable cassette form.

The support member may also be provided at a region other than both ends of the polyester fiber sound absorbing cylinders.

A plurality of semicircular notches may be provided in the support member to provide a sound absorbing structure in which both ends of the polyester fiber sound absorbing cylinders can be fitted in the notches, and the support member and the both ends of the polyester fiber sound absorbing cylinders may be laid alternately to form an array.

According to the present invention, noise reduction can be achieved while reducing the airflow resistance, thus making it possible to minimize a decrease in the amount of cooled air and improve the package heat radiation performance. Moreover, since enough heat radiation performance can be provided, a cooling fan can be downsized, which makes it possible to reduce noise generated from the cooling fan, reduce the fan power, and make the sound-absorbing structure even smaller, thus permitting achieving downsizing of the package.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE PREFERRED EMBODIMENTS

Hereinafter, the embodiments of the present invention will be described, with reference to the accompanying drawings.

Figure 12:
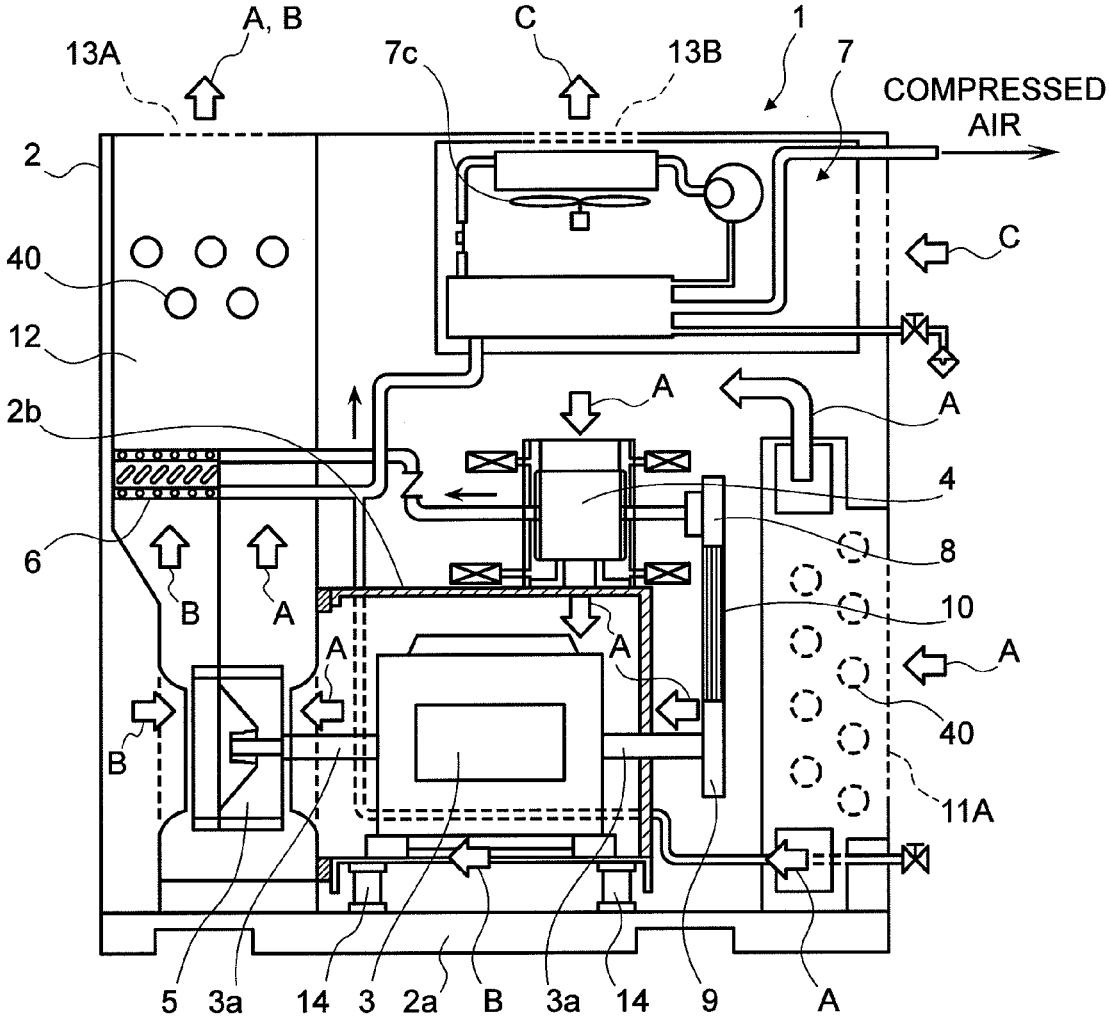
FIG. 12 is a configuration diagram showing the structure of the low-noise package provided with the sound absorbing structure according to the first embodiment or the second embodiment.

FIG. 12 is a longitudinal sectional view showing the schematic structure of an air compressor unit to which low-noise packages of the embodiments are applied. In FIG. 12, the air compressor unit 1 is fixed on a base 2*a* in a casing 2 forming a contour or framework of the air compressor unit 1. The air compressor unit 1 includes: a well-known motor 3 of the type that is fixed to the support member 2*b* supported by support poles 14 in the casing 2; an outer peripheral driving type scroll compressor 4 that is fixed to the support member 2*b* in the same manner and that generates compressed air; a cooling fan 5 that attracts external air into the casing 2 to air-cool the motor 3 and the outer peripheral driving type scroll compressor 4; a heat exchanger 6 that cools down the compressed air from the outer peripheral driving type scroll compressor 4 to an adequate temperature; and a dryer 7 that dehumidifies the compressed air from the heat exchanger 6 to an adequate humidity.

The outer peripheral driving type scroll compressor 4 includes a V pulley 8. In conjunction with rotational driving of the motor 3, to the outer peripheral driving type scroll compressor 4, a rotative power is transmitted via a V pulley 9 provided on a side (right side in FIG. 12) of one of motor rotation axes 3*a* of the motor 3 and a V belt 10 mounted on these V pulleys 8 and 9.

The cooling fan 5 has a rotation axis thereof coupled to a side (left side in FIG. 12) of the other of the motor rotation axis 3*a*, and is driven in conjunction with driving of the motor 3. Then driving of this cooling fan 5, as shown by an arrow A in FIG. 12, flows external air into the casing 2 from a suction port 11A that has arranged therein sound absorbing cylinders 40 to be described later, and exhausts it via the cooling fan 5 and a duct 12 from an exhaust port 13A that has arranged therein sound absorbing cylinders 40 to be described later.

Consequently, the motor 3, the outer peripheral driving type scroll compressor 4, etc. in the casing 2 are cooled down with the external air. Moreover, simultaneously therewith, external air from the suction port 11A is discharged to the heat exchanger 6 provided in the duct 12 via the cooling fan 5 and then exhausted from the exhaust port 13A. Consequently, the heat exchanger 6 cools down the compressed air from the outer peripheral driving type scroll compressor 4 down to an adequate temperature.

The dryer 7 includes a compressor, a condenser, a capillary tube, and an evaporator, and thereby dehumidifies the compressed air from the heat exchanger 6 to an adequate humidity. Moreover, at this point, since the dryer 7 is provided with a fan 7C that air-cools the condenser and the evaporator, the air is exhausted from an exhaust port 13B as shown by arrow C in FIG. 12.

Figure 4:
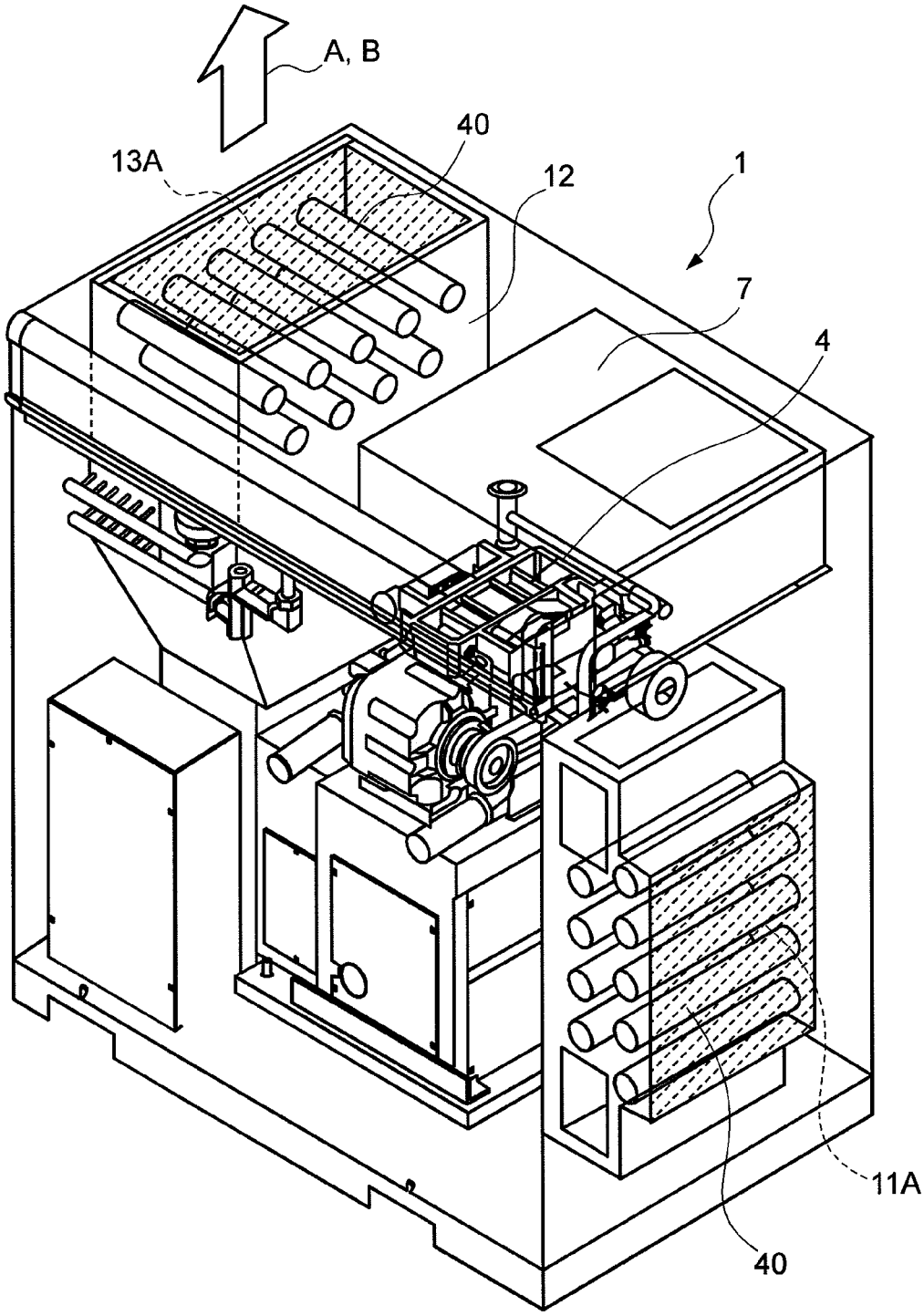
FIG. 4 is a bird's-eye view of a low-noise package having fixed therein the sound absorbing structure according to the first embodiment or the second embodiment.

FIG. 4 is a bird's-eye view of the structure of the air compressor unit 1 shown in this embodiment as viewed diagonally from above the right front side. In the air compressor unit 1, the outer peripheral driving type scroll compressor 4, the cooling fan 5, and the motor 3 serve as main sources of vibration and noise. In this embodiment, a sound-absorbing structure is formed which has a plurality of air-absorbing cylinders 40 arranged at the suction port 11A and the exhaust port 13A in parallel to the surfaces of these ports, that is, in a manner such that the longer axes of the sound absorbing cylinders 40 intersect substantially perpendicularly with the air flow direction.

Figure 1A:
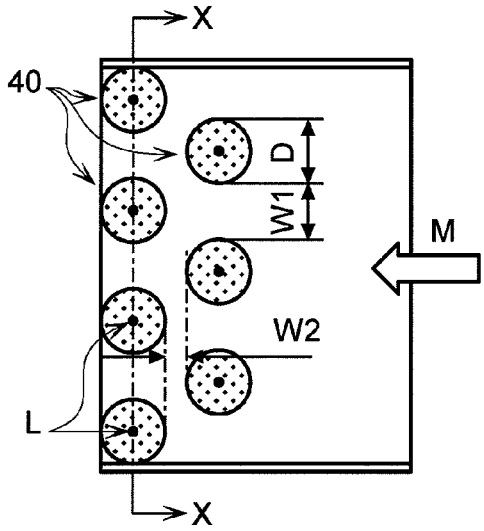
FIG. 1A is a side view of a sound absorbing structure according to a first embodiment.
Figure 1B:
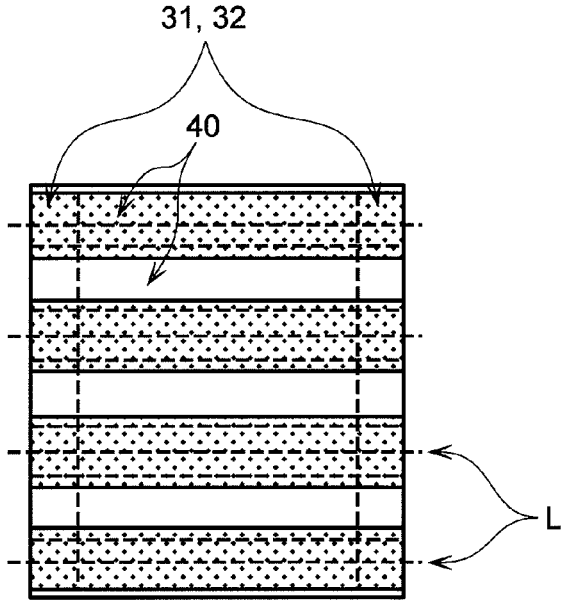
FIG. 1B is a sectional view taken along a line X-X in FIG. 1A.

Here, the sound-absorbing structure will be described in more detail. FIG. 1A is a side view showing the side of the sound-absorbing structure, and FIG. 1B is a sectional view taken along a line X-X in FIG. 1A. Intervals W1 and W2 between the sound absorbing cylinders 40 are determined in view of the flow resistance so that they are in a range of 50% to 150% of a diameter D of the sound absorbing cylinder 40. Moreover, as described above, the sound-absorbing structure is formed which has a plurality of sound absorbing cylinders 40 arranged in a manner such that the longer axes L of the sound absorbing cylinders 40 intersect substantially perpendicularly with the air flow direction M, as shown in the figure. Providing this structure achieves a structure capable of effectively reducing noise from the suction port 11A and the exhaust port 13A without increasing the flow resistance to cooling air A and B. In this embodiment, the sound absorbing cylinders 40 are arrayed in zigzag alignment, although they may be arrayed in alignment other than the zigzag alignment.

Figure 2:
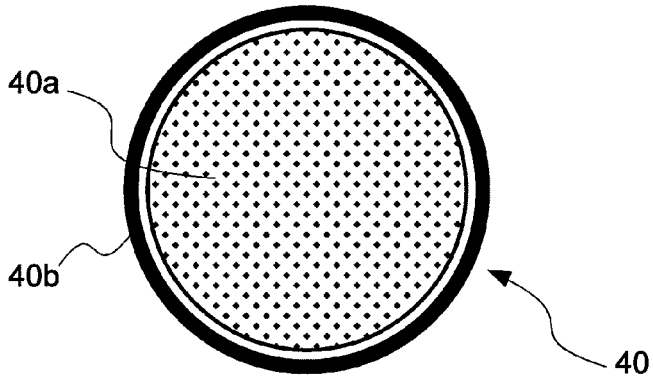
FIG. 2 is a sectional view showing the structure of a sound absorbing cylinder according to the first embodiment along one diameter thereof.

Next, the structure of the sound absorbing cylinder 40 will be described. FIG. 2 is a sectional view showing the structure of the sound absorbing cylinder 40 along one diameter thereof. As shown in FIG. 2, the sound absorbing cylinder 40 is structured of a base material 40*a* of polyester fiber formed into a circular-cylindrical shape whose surface is wound, combined, and covered with polymer nonwoven fabric 40*b* of polyester fiber or the like. For example, the surface of a base material of polyester fiber, having a thickness of 30 mm and a bulk density of 44 kg/m$^3$, is heat-sealed and combined with polyester nonwoven fiber by powder-like hot melt to thereby form a sound absorbing cylinder.

Figure 6:
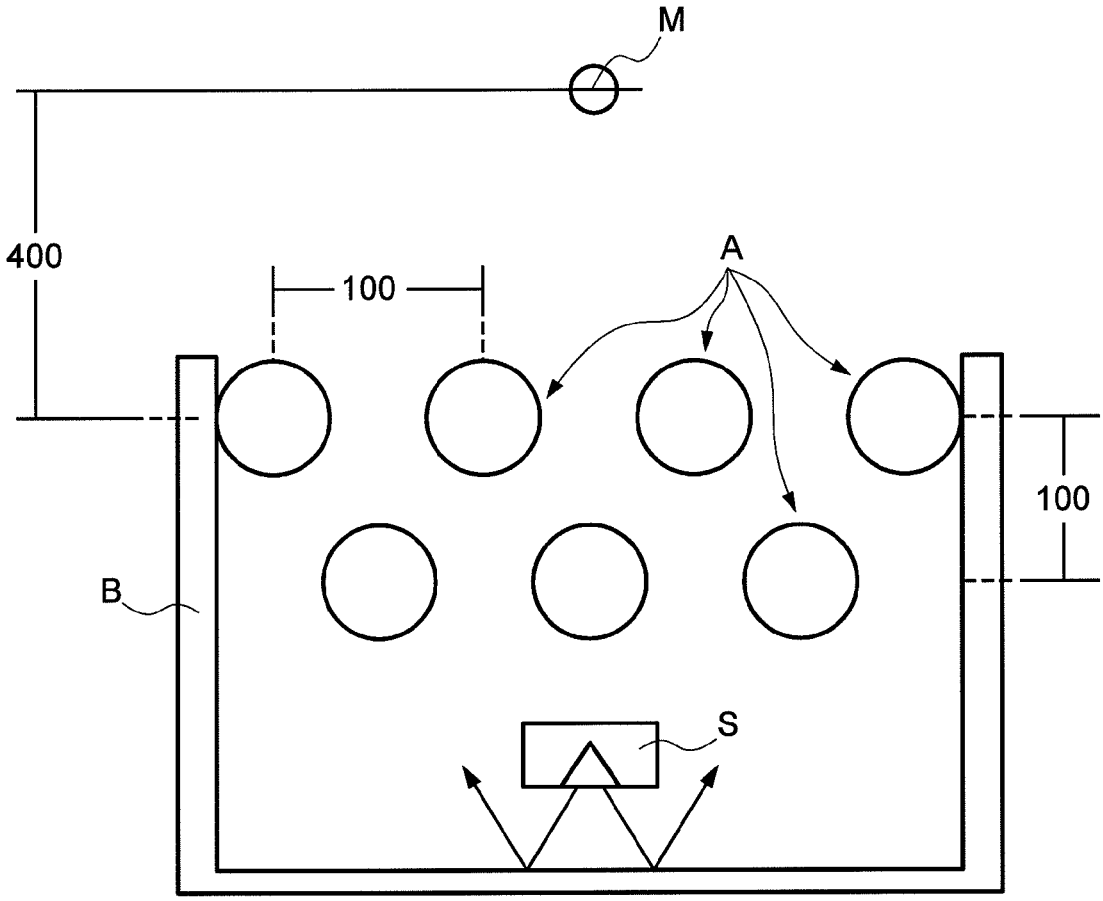
FIG. 6 is a sectional view of an experimental device for checking sound absorbing effect provided by the sound absorbing structure according to the first embodiment.
Figure 7:
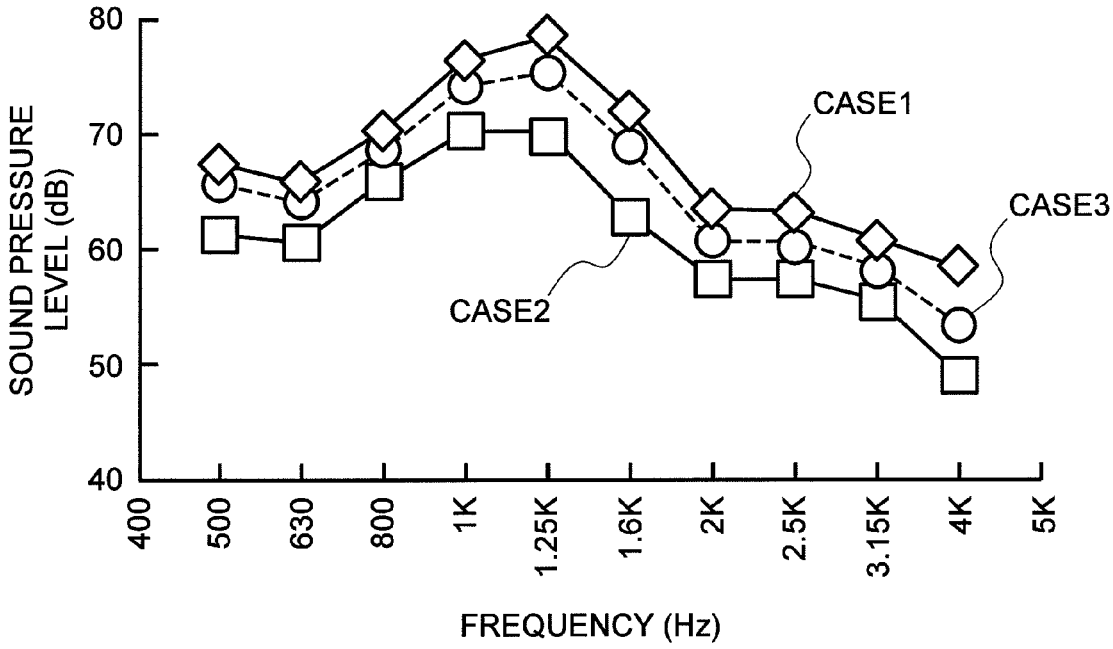
FIG. 7 is a comparative diagram indicating the sound absorbing effect provided by the sound absorbing structure according to the first embodiment.

To check the effect of this embodiment, under the condition that a speaker S is placed in an experimental box B as shown in FIG. 6 and pink noise is generated, sound pressure levels for ⅓ Oct. Band central frequency under the presence and absence of a sound-absorbing structure formed of sound absorbing cylinders A are measured with a microphone M for comparison. FIG. 7 shows results of this comparison. CASE 1 refers to a case where the sound-absorbing structure is completely absent. CASE 2 refers to a case where sound absorbing cylinders each formed of a base material of polyester fiber (35 kg/m$^3$) whose surface is combined with polyester fiber nonwoven fabric are installed. CASE 3 refers to a case where sound-absorbing cylinders each formed of only a base material of polyester fiber (35 kg/m$^3$) whose surface is not combined with polyester fiber nonwoven fabric are installed. It can be understood that even in CASE 3, as compared to CASE 1, noise is more reduced in a wide band of 500 to 4 kHz centered at 1.25 kHz, and that noise is even more considerably reduced in CASE 2.

Figure 8:
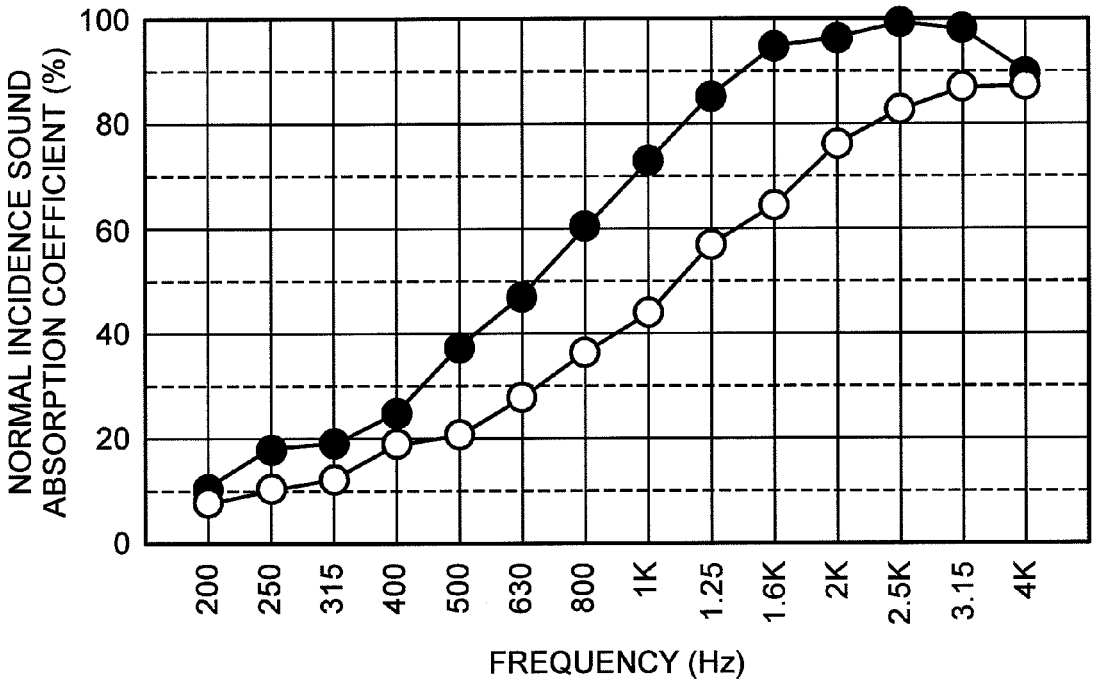
FIG. 8 is a comparative diagram indicating sound absorbing properties in a case where polyester nonwoven fabric is combined with the surface of a base material of polyester fiber.

This is attributable to an improvement in sound-absorbing properties as a result of combining the surface of the base material of polyester fiber with the polyester nonwoven fabric. The ground for this is shown in FIG. 8. FIG. 8 is a diagram making a comparison between a sound absorbing cylinder (○ marks in the figure) formed of a base material only and a sound absorbing cylinder (● marks in the figure) formed of a base material (of polyester fiber having a thickness of 30 mm and a density of 44 kg/m$^s$) whose surface is heat-sealed with and combined with polyester nonwoven fabric by powder-like hot melt, where a horizontal axis represents the frequency and the vertical axis represents the normal incidence sound absorption coefficient. As is obvious from this figure, as compared to the sound absorbing cylinder formed of a base material only, combining the surface of the base material with the nonwoven fabric by using the heat-sealing powder is proved to dramatically improve the sound absorbing properties.

Figure 10:
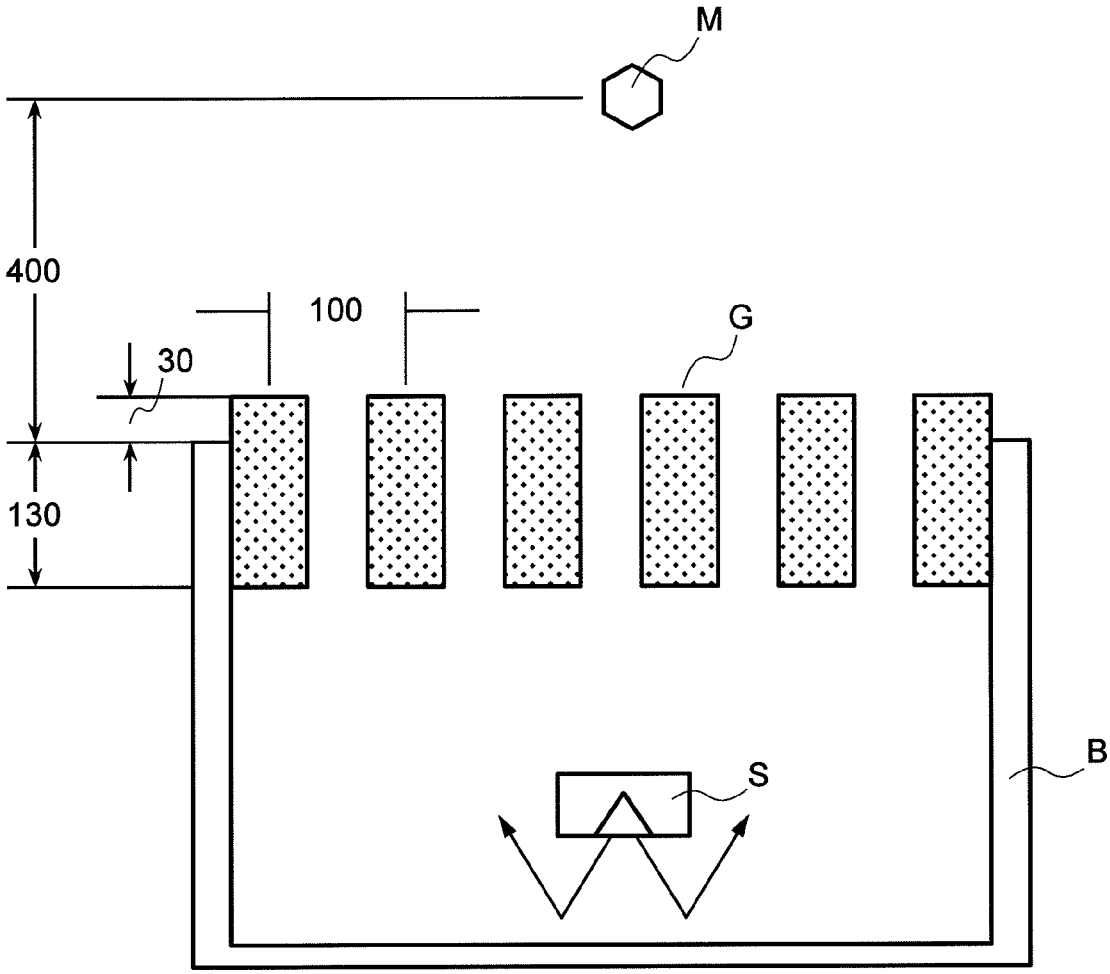
FIG. 10 is a sectional view of an experimental device for checking sound absorbing effect provided by a conventional structure.
Figure 11:
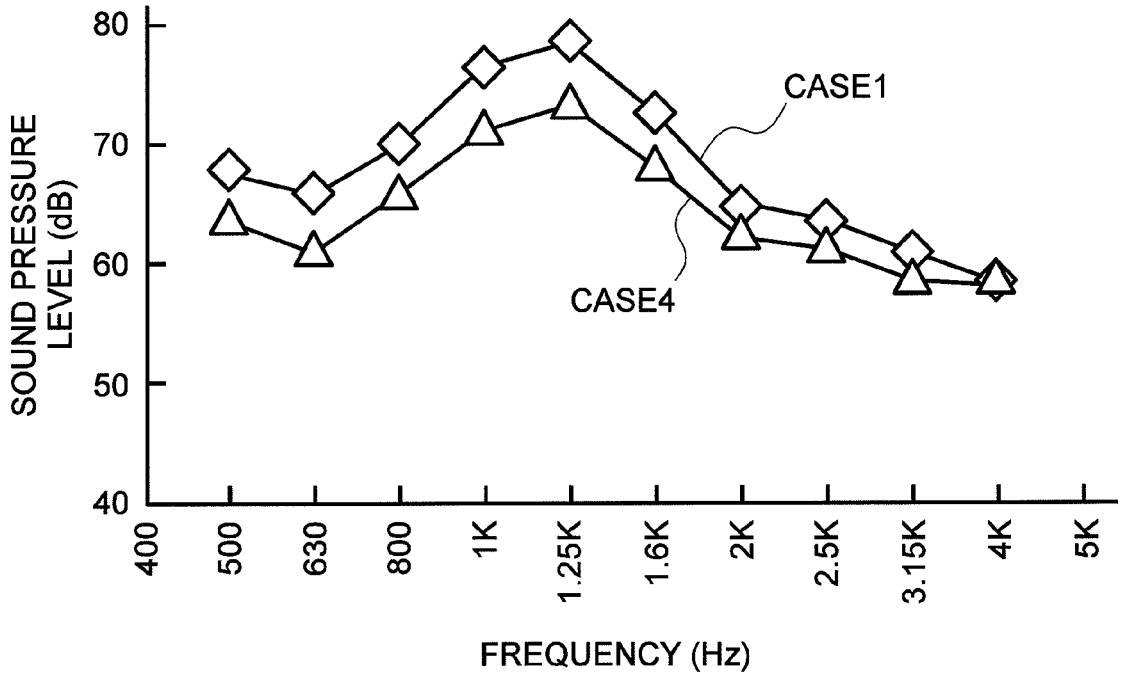
FIG. 11 is a comparative diagram indicating the sound absorbing effect provided by the conventional structure.

On the other hand, under the condition that, as shown in FIG. 10, in the experimental box B described above, a conventional structure having glass wools G of 32 kg/m$^3$ machined into a size of 60 mm×160 mm and arranged at intervals of 40 mm is provided, a speaker S is placed, and pink noise is generated, sound pressure levels for ⅓ Oct. Band central frequency under the presence and absence of the sound absorbing structure formed of glass wools G is measured with a microphone M, the results of which are shown in FIG. 11. As shown in FIG. 11, in CASE 4 referring to the conventional structure, as compared to CASE 1 where the sound absorbing structure is completely absent, sound absorbing effect is observed, but with much more unfavorable results than those of this embodiment especially in a high frequency band. Thus, this embodiment provides a structure that is not only more excellent in the sound reduction performance but also more advantageous in the flow resistance.

As described above, since not only the base material of polyester fiber is provided, but also the polymer nonwoven fabric of polyester fiber or the like is combined with the surface of the base material, the sound absorbing performance dramatically improves, thus providing great sound absorbing effect. Moreover, the shape is circular-cylindrical, which facilitates air circulation and, also due to a short passage, the airflow resistance considerably improves. This solves a problem of antinomy between the sound absorbing effect and the airflow resistance which a conventional air absorbing duct faces.

Since the sound absorbing cylinder 40 is structured of the base material 40*a* of polyester fiber formed into a circular-cylindrical shape whose surface is covered with the polymer nonwoven fabric 40*b* of polyester fiber or the like, the sound absorbing cylinder 40 may be inferior in strength, thus probably failing to maintain its shape when an external force acts thereon. Thus, the sound absorbing cylinder 40 may be structured such that, as a core material of the sound absorbing cylinder 40, a solid or hollow shaft for reinforcing fitting penetrates therethrough.

Moreover, to protect the surface of the sound absorbing cylinder 40, a metallic or resin-based network structure or perforated structure may be provided on the polymer nonwoven fabric 40*b* on the surface of the sound absorbing cylinder 40.

Instead of the base material 40*a* of polyester fiber, a base material of glass wool or flexible urethane foam also fulfills the same function.

Further, as shown in FIG. 1, to insert the sound absorbing cylinders 40 in support members 31 and 32 to form an array of the sound absorbing cylinders 40, one ends of the sound absorbing cylinders 40 first need to be inserted in the support member 31 and then the other ends thereof need to be inserted in holes of the support member 32. If the number of sound absorbing cylinders 40 forming the array is small, it is possible in some way to insert the other ends of the sound absorbing cylinders 40 in the support member 32. However, as the number of sound absorbing cylinders 40 increases, it may become more difficult to insert the sound absorbing cylinders 40 in the holes of the support member 32.

Figure 14:
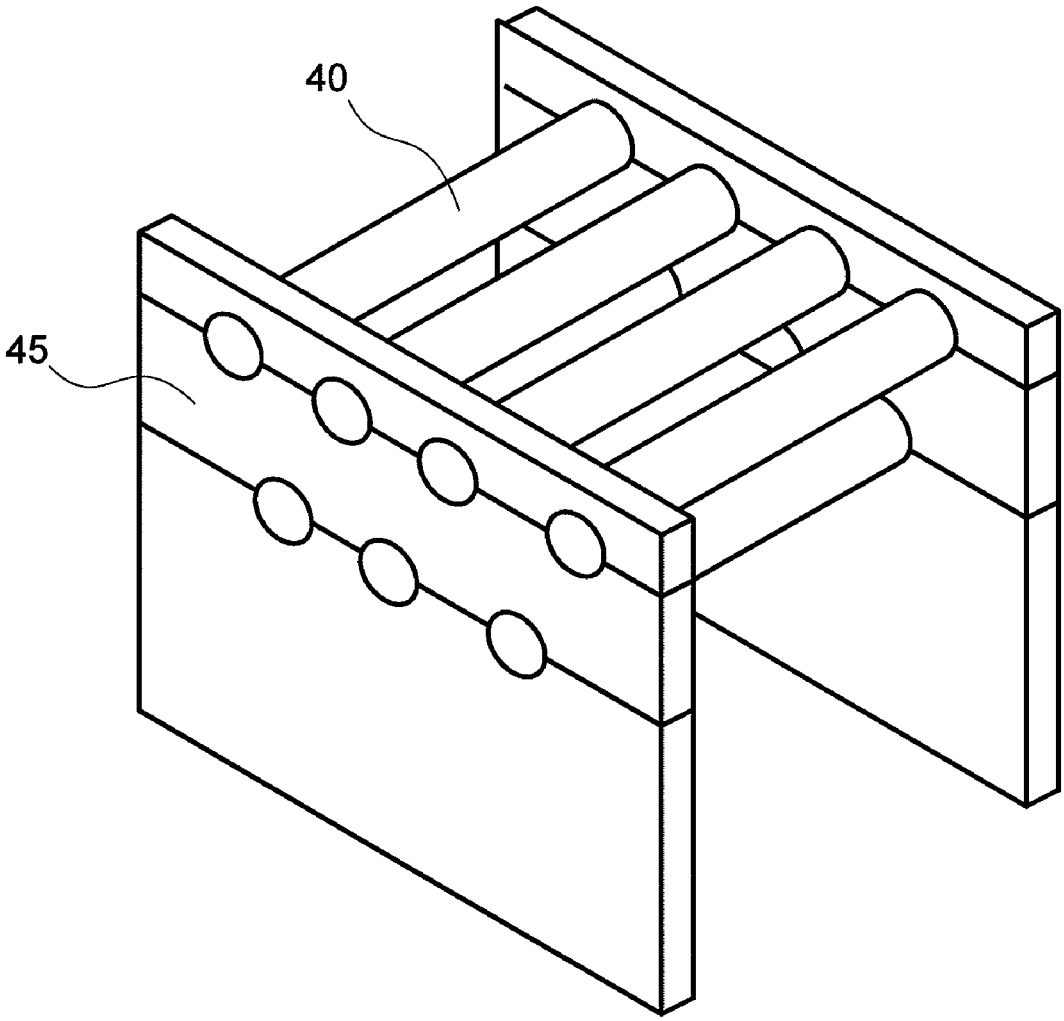
FIG. 14 is a bird's-eye view showing a sound absorbing cylinder support structure formed with a laminated support member in the sound absorbing structure according to the first embodiment or the second embodiment.

Thus, as shown in FIG. 14, an array of the sound absorbing cylinders 40 and layered support members 45 as members fixing the sound absorbing cylinders 40 may form a sound-absorbing structure. At portions of this layered support member 45 where the sound absorbing cylinders 40 are to be fitted, semicircular notches are provided. In the plurality of semicircular notches of the layered support member 45, the sound absorbing cylinders 40 are respectively fitted. Thereafter, a different layered support member 45 is fitted in such a manner as to sandwich the fitted sound absorbing cylinders 40. By repeating this, the array is formed. Forming the array in this manner can solve the difficulties in fitting the sound absorbing cylinders 40 due to an increase in the number of sound absorbing cylinders 40, thus considerably improving the operability.

Figure 5:
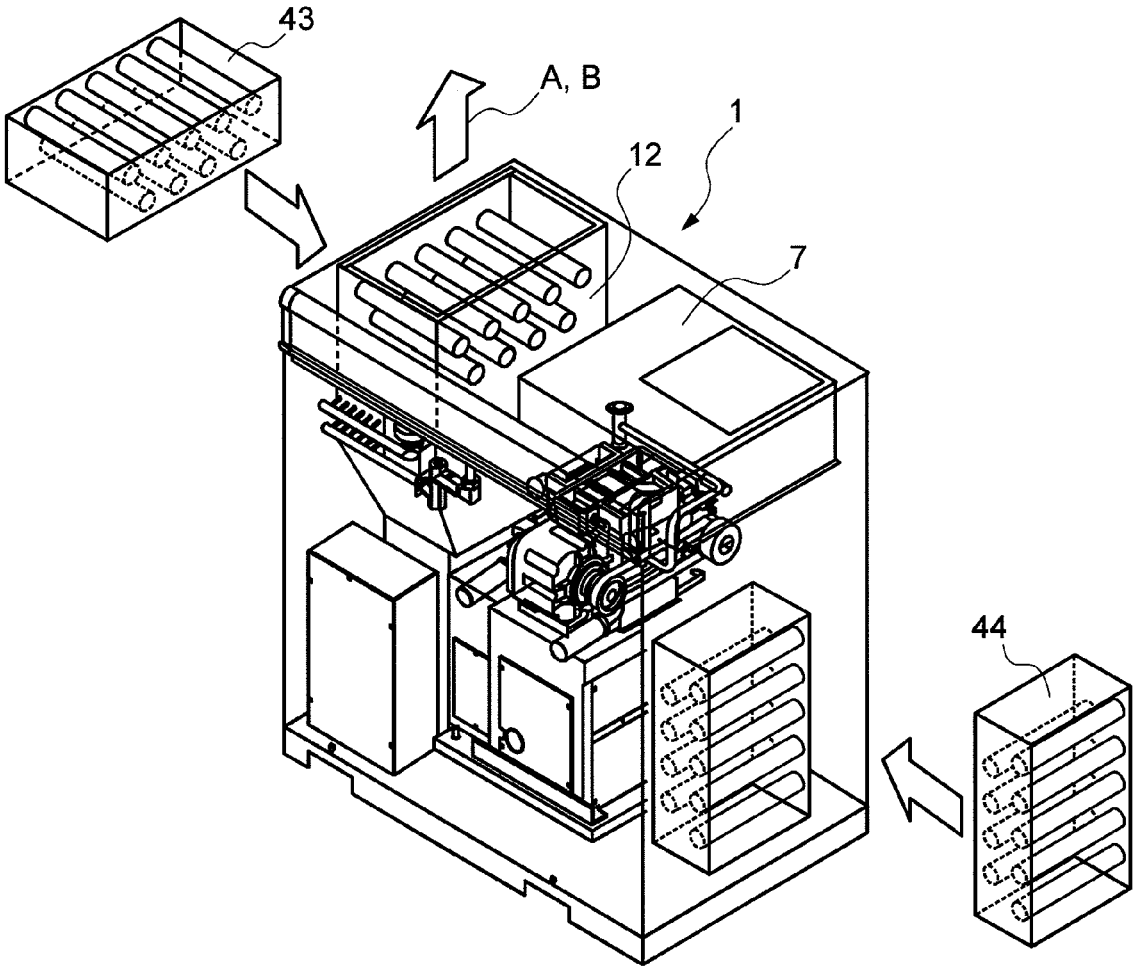
FIG. 5 is a bird's-eye view of a low-noise package having the sound absorbing structure according to the first embodiment or the second embodiment in a cassette form.

As a method of fitting the sound absorbing cylinders 40 to the air compressor unit 1, as shown in FIG. 4, they may be fixed directly to the suction port 11A and the exhaust port 13A. For easier maintenance, as shown in FIG. 5, members, like cassettes 43 and 44, including a combination of sound absorbing cylinders 40, may be provided in a freely detachable cassette form. Providing the cassette structure has the advantage that it can be easily fitted as a module for noise reduction.

Figure 3:
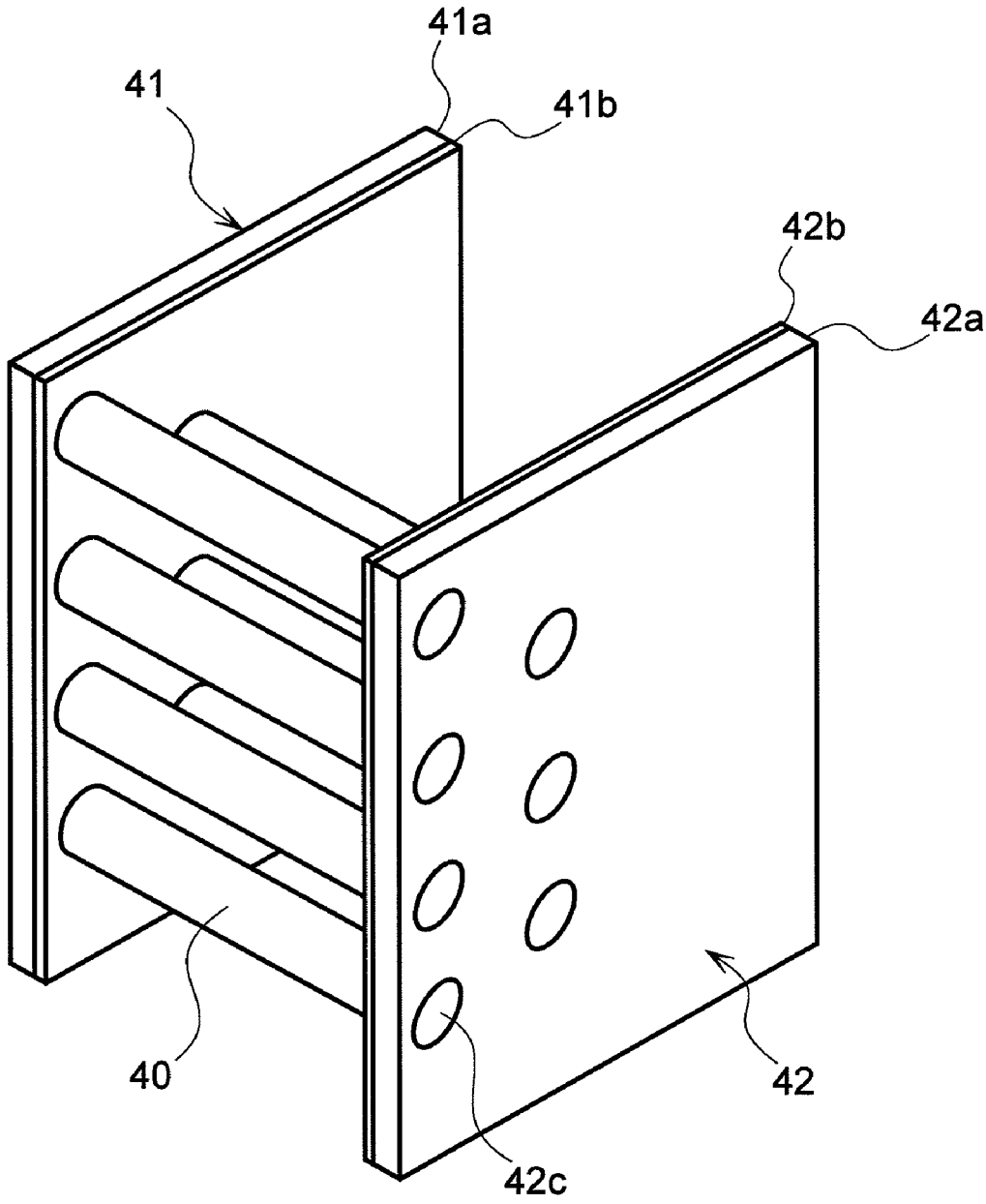
FIG. 3 is a bird's-eye view showing a sound absorbing structure according to a second embodiment.

Next, the second embodiment of the present invention will be described. In this embodiment, in addition to sound absorbing cylinders each formed of a base material of polyester fiber whose surface is combined with polyester-fiber-based nonwoven fabric, a support member supporting this sound absorbing cylinder is also structured to have sound absorbing effect. Specifically, as shown in FIG. 3, a polyester fiber sound absorbing member formed of a base material of polyester fiber whose surface is combined with polymer nonwoven fabric of polyester fiber or the like is provided with holes for supporting the sound absorbing cylinders and provided at the both ends of a package opening so that the sound absorbing cylinders are inserted therein. This structure achieves overall noise reduction. Other structure of an air compressor unit 1 to which a low-noise package of this embodiment is applied is the same as that of FIG. 12 and thus its description will be omitted here.

The structure for supporting the absorbing cylinders 40 is achieved in the following manner. As shown in FIG. 3, in the sound absorbing members 41 and 42 arranged at the both ends of the sound absorbing cylinders 40, holes 41*c* and 42*c* for supporting the sound absorbing cylinders 40 are provided, and then the both ends of the sound absorbing cylinders 40 are respectively inserted in the holes 41*c* and 42*c* of the sound absorbing members 41 and 42. The sound absorbing members 41 and 42 are respectively formed of base materials 41*a* and 42*a* of polyester fiber whose surfaces are respectively combined with polymer nonwoven fabric 41*b* and 42*b* of polyester fiber or the like.

Figure 9:
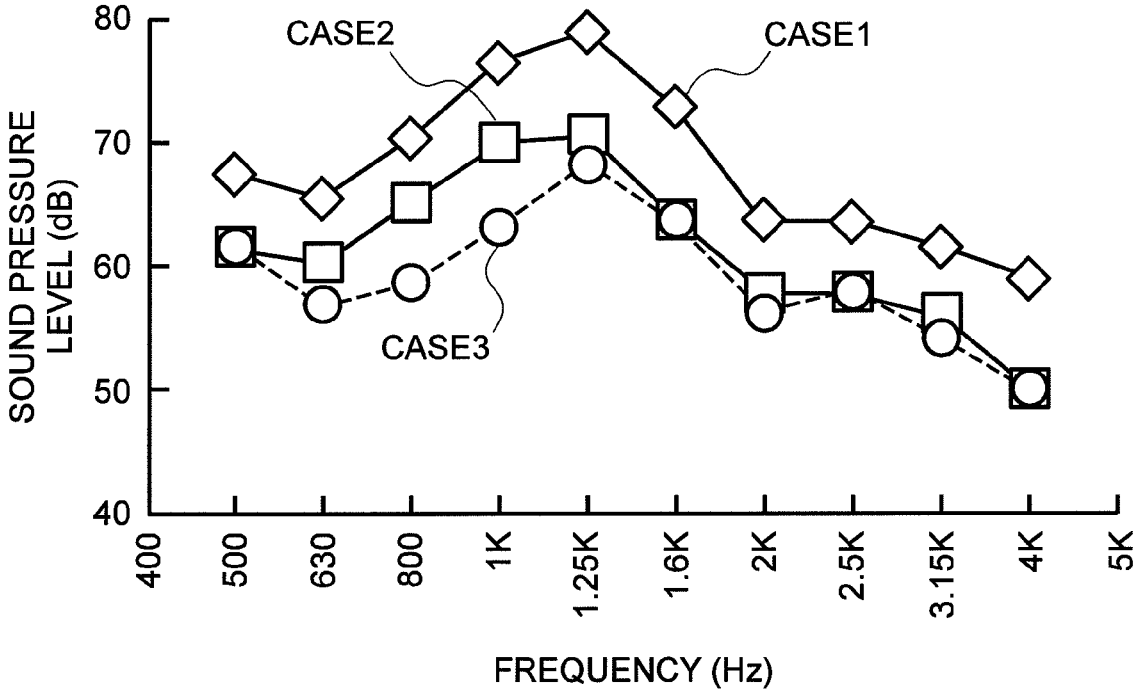
FIG. 9 is a comparative diagram indicating sound absorbing effect provided by the sound absorbing structure according to the second embodiment.

Here, sound absorbing effect provided by the sound absorbing members 41 and 42 will be described, referring to FIG. 9. In FIG. 9, CASE 1 refers to a case where the sound-absorbing structure is completely absent. CASE 2 refers to a case where only sound absorbing cylinders each formed of a base material of polyester fiber (35 kg/m$^3$) whose surface is combined with polyester fiber nonwoven fabric are installed. CASE 3 refers to a case where sound absorbing cylinders each formed of a base material of polyester fiber (35 kg/m$^3$) whose surface is combined with polyester fiber nonwoven fabric are installed together with the aforementioned polyester fiber sound absorbing members (of 35 kg/m$^3$, and 25 mm in thickness). As is obvious from FIG. 9, it is proved that providing this structure, with sound absorbing effect provided by the sound absorbing members 41 and 42 in addition to the sound reducing effect provided by the sound absorbing cylinders 40, can achieve more effective sound reducing effect especially in the range of 630 Hz to 1 KHz than is achieved by the first embodiment described above.

Figure 13:
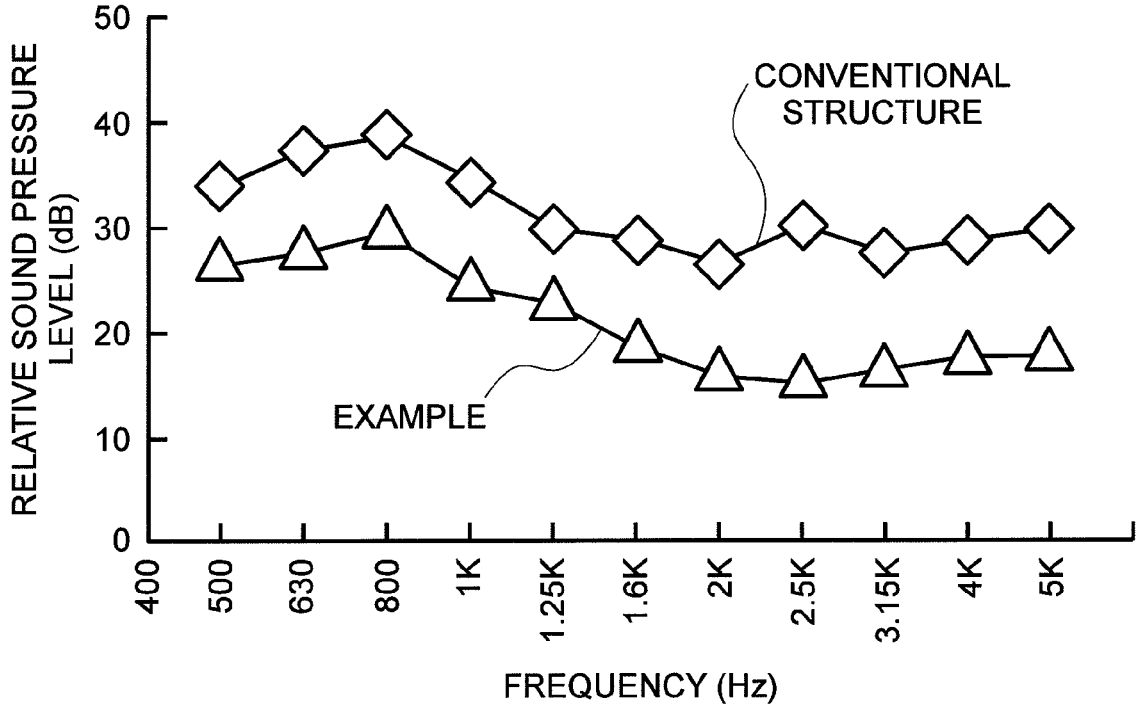
FIG. 13 is a comparative diagram comparing sound absorbing effect between the low-noise package of the second embodiment and a conventional package on actual machines.

Further, the amounts of sound reduction achieved by a conventional structure combining together a sound absorbing duct using flexible urethane foam for a suction port and an exhaust port and sound absorbing processing in the package and by the structure of this embodiment adopting the sound absorbing cylinders 40 and the sound absorbing members 41 and 42 are checked on actual machines, results of which are shown in FIG. 13. It is proved that the package to which this embodiment is applied provides greater sound reducing effect even on the actual machine than the conventional structure. Needless to say, the package can also keep down temperatures of the different parts in the package to the same degrees as are achieved by the conventional structure.

Moreover, instead of the base materials 41*a* and 42*a* of polyester fiber, base materials of glass wool or flexible urethane foam also fulfill the same function.

To more stably support the sound absorbing cylinders 40, the sound absorbing cylinders 40 can be supported at a portion other than the both ends of the sound absorbing cylinders 40. Further, needless to say, the noise reduction performance can also be enhanced by disposing a polyester fiber sound absorbing member on a surface other than the surfaces of the package supporting the sound absorbing cylinders.

Also in this embodiment, forming an array of sound absorbing cylinders 40 with sound absorbing members of a layered structure as described in the first embodiment can solve the difficulties in fitting due to an increase in the number of sound absorbing cylinders 40, thus considerably improving the operability.

As a method of fitting the sound absorbing cylinders 40 to the air compressor unit 1 in this embodiment, as described in the first embodiment, the sound absorbing cylinders 40 may be fixed directly to the suction port 11A and the exhaust port 13A, or may be provided in a freely detachable cassette form for easier maintenance. Also in this embodiment, providing the cassette structure has the advantage that it can be easily fitted as a module for noise reduction.

The model experiments and the evaluation described above demonstrate excellent performance of a low-noise package of this embodiment that solves the antinomy between the heat radiation performance and the noise reduction performance. The noise reduction performance in particular, as compared to other methods, is excellent, providing great sound absorbing effect in a wider frequency band.

The invention claimed is:

1. A low-noise machine package comprising:

a compressor as a source of noise;

a heat exchanger;

a cooling fan, which flows air from a suction port to an exhaust port, as a source of noise;

a sound absorbing structure; and a casing accommodating the compressor, the heat exchanger, the cooling fan and the sound absorbing structure, and having the suction port and the exhaust port from which noise are leaked to the outside of the casing, wherein the sound absorbing structure has a plurality of polyester fiber sound absorbing cylinders each formed into a circular-cylindrical shape and arranged at a support member in at least either of the suction port and the exhaust port in such a manner that long axes of the sound absorbing cylinders intersect substantially perpendicularly with a flow direction of air flowing through the suction port or the exhaust port, wherein each of the polyester fiber sound absorbing cylinders is a sound absorbing body formed into a circular-cylindrical shape formed of a base material of polyester fiber whose surface is circular-cylindrically wound and combined with polymer nonwoven fabric by powder like hot melt in such a way that a sound absorption coefficient of the sound absorbing cylinder is higher than that of the base material alone.

2. The low-noise machine package according to claim 1, having a structure having a solid shaft or a hollow shaft penetrated through a circular-cylindrical center of the polyester fiber sound absorbing cylinder.

3. The low-noise machine package according to claim 1, wherein on the polymer nonwoven fabric, a metallic or resin-based network structure or perforated structure is provided.

4. The low-noise machine package according to claim 1, wherein the support member is a polyester fiber sound absorbing member.

5. The machine low-noise according to claim 4, wherein the polyester fiber sound absorbing member is provided as a sound absorbing structure formed of a base member of polyester fiber whose surface is combined with polymer nonwoven fabric.

6. The low-noise machine package according to claim 1, wherein the support member comprises a base member made of glass wool or flexible urethane foam whose surface is combined with polymer nonwoven fabric.

7. The low-noise machine package according to claim 1, wherein the sound-absorbing structure is in a freely detachable cassette form.

8. The low-noise machine package according to claim 1, wherein the support member is also provided at a region other than both ends of the polyester fiber sound absorbing cylinders.

9. The low-noise machine package according to claim 1, wherein: a plurality of semicircular notches are provided in the support member to provide a sound absorbing structure in which both ends of the polyester fiber sound absorbing cylinders can be fitted in the notches; and the support member and the both ends of the polyester fiber sound absorbing cylinders are laid alternately to form an array.

* * * * *